US008182072B2

(12) United States Patent
Ibe et al.

(10) Patent No.: US 8,182,072 B2
(45) Date of Patent: May 22, 2012

(54) SUBSTRATE FOR INKJET PRINTING HEAD AND METHOD FOR MANUFACTURING THE SUBSTRATE

(75) Inventors: Satoshi Ibe, Yokohama (JP); Hirokazu Komuro, Yokohama (JP); Takuya Hatsui, Tokyo (JP); Keisuke Kishimoto, Yokohama (JP); Hiroto Komiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 924 days.

(21) Appl. No.: 12/105,931

(22) Filed: Apr. 18, 2008

(65) Prior Publication Data

US 2008/0259130 A1 Oct. 23, 2008

(30) Foreign Application Priority Data

Apr. 20, 2007 (JP) ..... 2007-111992

(51) Int. Cl.
*B41J 2/05* (2006.01)

(52) U.S. Cl. ..... 347/63; 347/56; 347/62

(58) Field of Classification Search ..... 347/56, 347/61–64, 105
See application file for complete search history.

(56) References Cited

U.S. PATENT DOCUMENTS

| | | | | |
|---|---|---|---|---|
| 2002/0057314 | A1* | 5/2002 | Miyamoto et al. | 347/61 |
| 2002/0126181 | A1* | 9/2002 | Miyamoto et al. | 347/63 |
| 2005/0128254 | A1* | 6/2005 | Ibe et al. | 347/58 |
| 2007/0296797 | A1* | 12/2007 | Yamade | 347/202 |

FOREIGN PATENT DOCUMENTS

| | | |
|---|---|---|
| JP | 06-286149 | 10/1994 |
| JP | 10-016242 A | 1/1998 |
| JP | 11-348290 | 12/1999 |
| JP | 2003-127367 A | 5/2003 |
| JP | 2005-199701 A | 7/2005 |
| JP | 2006-210815 | 8/2006 |

* cited by examiner

*Primary Examiner* — Charlie Peng
*Assistant Examiner* — Hung Lam
(74) *Attorney, Agent, or Firm* — Canon USA Inc IP Division

(57) ABSTRACT

There is provided a substrate for an inkjet printing head and a method for manufacturing the same, in which the substrate has a structure that different kinds of metals do not come into contact with ink or moisture. For this purpose, the structure is constituted such that a diffusion preventing layer for mainly protecting a lower layer among power wiring metals is covered by a metal layer for mainly supplying power, in connection with its upper surface and at least part of a side surface. Herewith, since a single metal appears on a surface of the power wiring including up to its side surface, even circumstance occurs of coming into contact with the ink or the moisture, a battery reaction accompanied by difference of ionization tendency is not generated, and thus corrosion or short-circuit of the power wiring is suppressed.

6 Claims, 6 Drawing Sheets

SUBSTRATE FOR INKJET PRINTING HEAD AND METHOD FOR MANUFACTURING THE SUBSTRATE

BACKGROUND OF THE INVENTION

1. Field of the Invention

The present invention relates to a method for manufacturing an inkjet printing head, and particularly to a manufacturing technique of a power wiring for supplying drive power.

2. Description of the Related Art

An inkjet printing system utilizing a heating resistor (heater) is widely used because printing elements capable of realizing high drive frequency (ejection frequency) can be arranged in comparatively high density.

FIGS. 3A and 3B are a perspective view and a cross sectional view for explaining a general configuration of a printing head adopting such inkjet printing system. A heating resistor layer 205 forming heating resistors 205*a* to cause bubbles generated within ink, and wiring layers 201 and 202 performing electric connection to the heating resistor layer 205 are formed in high density on a substrate 200. Further, the substrate has a protective layer 206 for protecting the above wiring from the ink, and a heat storage layer 204 for storing heat. On the other hand, on a nozzle member 207, at a position corresponding to individual heating resistor 205*a*, a plurality of ink paths for leading the ink to a ejection opening 208 are formed in high density. A printing head is formed in such a way that the nozzle member 207 is adhered to the substrate 200 constituted as described above, in a condition as shown in FIG. 3A. Then, heat energy generated from the heating resistor causes the bubbles generated in the ink within the ink path, and the ink with an amount corresponding to a growing energy of the bubbles is ejected from the ejection opening 208.

For instance, Japanese Patent Laid-Open No. H06-286149 discloses a method for manufacturing a nozzle member provided with a plurality of ink paths arranged in high density and high accuracy. According to the present document, there is disclosed a manufacturing process in which, first, an ink path pattern is formed by using soluble resin, a covering resin including epoxy resin solid at ordinary temperature is applied to the ink path pattern, and the soluble resin layer is dissolved and eliminated after forming the ink ejection openings.

In addition, Japanese Patent Laid-Open No. H11-348290 discloses a method for bonding a covering resin being a nozzle member to a substrate on which a heating resistor and its wiring are formed in high density via an adhering layer made of a polyether amid resin.

Meanwhile, when referring to FIG. 3B, in such a substrate for inkjet printing head, a power wiring for supplying the drive power to the heating resistor 205*a* is formed with a two-layer structure of power wiring layers 201 and 202. Then, a current is led to the heating resistor 205*a* via a through hole part 203 formed on part of the two layers.

Conventionally, in such a power wiring layer, aluminum is frequently used. However, it is necessary to thicken an aluminum power wiring layer 201, or to thicken a width of an aluminum electrode wiring in the case of lowering a wiring resistance value. However, whichever method is used, since the substrate itself is made large, it is not appreciably to say a preferable method in manufacturing.

Compared with this, Japanese Patent Laid-Open No. 2006-210815 discloses a configuration in which gold (Au) having excellent characteristic as a wiring material with low current resistance is adopted as an electrode on the substrate. According to the document, a substrate manufacturing process is disclosed as being such that, by utilizing an electrolytic plating method, the gold (Au) as the electrode is formed on the substrate.

However, in the conventional substrate for the head in which the power wiring is formed by using electrolytic plating, battery reaction or the like accompanied by the difference of ionization tendency between different kinds of metals occurs, so that there are cases where corrosion or short-circuit of the power wiring is caused. Hereinafter, its cause will be described in detail.

In the conventional manufacturing process using the electrolytic plating method, a dry film formation is performed between a diffusion preventing material made of, for instance, TiW for performing foundation protection on a surface layer of the substrate, and gold of a foundation seed. In addition, in order to precipitate a metal wiring selectively by the electrolytic plating method, a photolithography technique is used. Further, with the metallic film formed as a mask, the above diffusion preventing material and gold of foundation seed are entirely etched by a dipping method. At this time, in the diffusion preventing layer, an etchant is introduced from also a lower side surface of the power wiring formed, and the side surface (cross section) is exposed by a side etching.

In the substrate for the inkjet printing head ejecting the ink being liquid, when the ink or the moisture or the like intrudes to part where the diffusion preventing material is exposed in such a way as above, the battery reaction accompanied by difference of ionization tendency between metallic material forming the diffusion preventing layer and the gold occurs. Then, this becomes cause of the corrosion or the short circuit of the power wiring.

Consequently, for instance, it is also possible to form an insulating inorganic film such as SiN by vacuum deposition so as to cover a cross-section surface of the diffusion preventing layer. However, it is difficult to perform the side etching uniformly in preferable condition to the lower side surface of the power wiring. When film thickness is thicken by the corresponding amount, thermal conductivity for the ink in the heating resistor decreases, and energy effect of the printing head itself becomes reduced.

SUMMARY OF THE INVENTION

The present invention is directed to a substrate for an inkjet printing head and a method for manufacturing the same, in which the substrate has a structure that different kinds of metals do not come into contact with an ink or moisture or the like, although the structure has a power wiring with low resistance formed by a plating method.

According to an aspect of the present invention, a substrate for an inkjet printing head includes a heating resistor layer forming a heating resistor configured to generate energy to eject ink, and a power wiring layer facilitating supplying power to the heating resistor. The power wiring layer includes a first metal layer facilitating supplying power, and a second metal layer configured to protect a lower layer. The first metal layer covers the second metal layer in connection with an upper surface and at least part of a side surface.

According to another aspect of the present invention, a method for manufacturing a substrate for an inkjet printing head includes forming a second metal layer for supplying power to a heating resistor formed on the substrate, forming an upper stage surface and a lower stage surface on the substrate upon removing part of the second metal layer, forming a first metal layer as a plating conductor on a whole surface, forming a resist on part of the lower stage surface, forming a plating while utilizing the first metal layer as the plating conductor, removing the resist and removing the first metal layer of the lower stage surface.

Further features of the present invention will become apparent from the following description of exemplary embodiments (with reference to the attached drawings).

DESCRIPTION OF THE EMBODIMENTS

Figure 1:
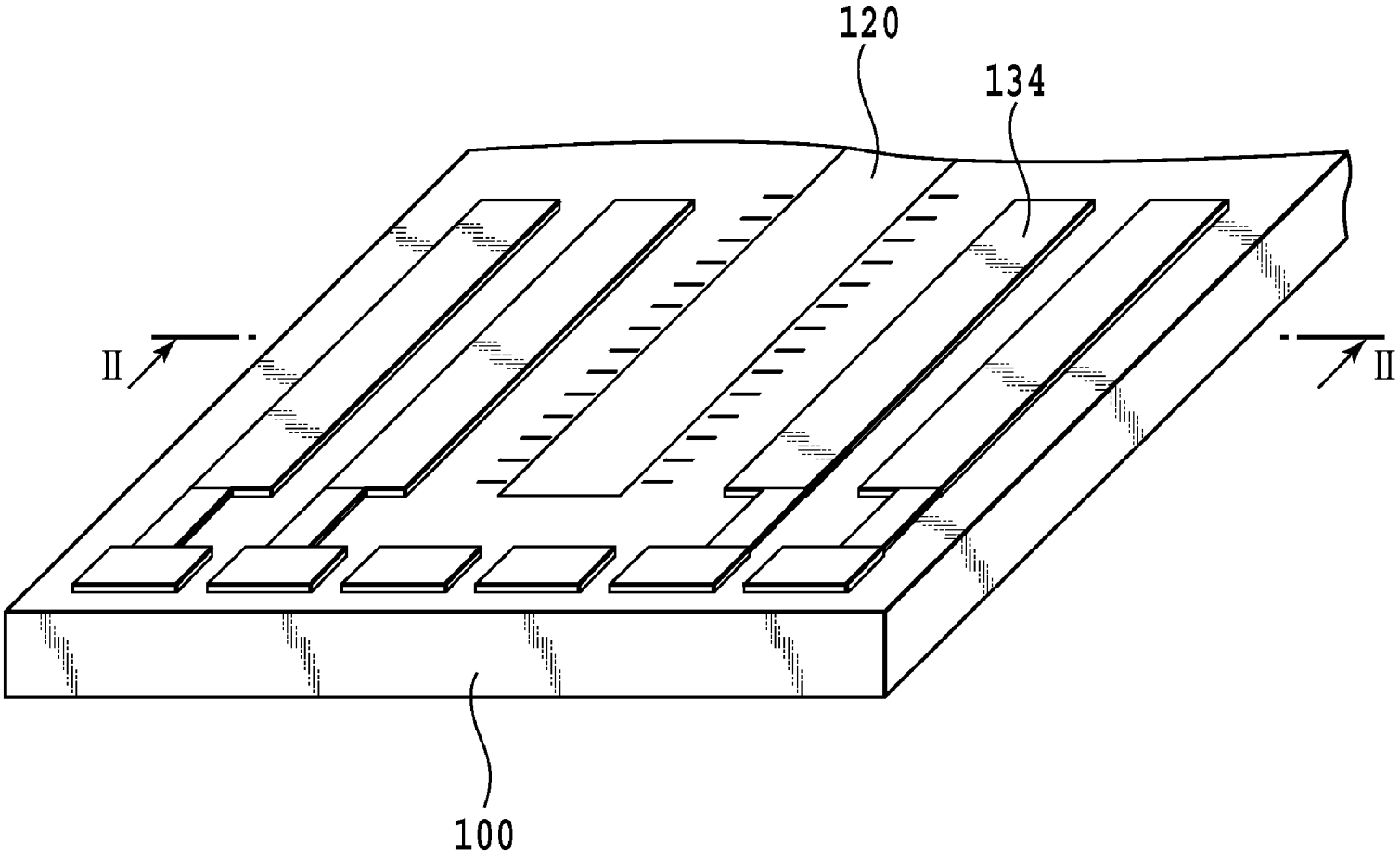
FIG. 1 is a perspective view for explaining configuration of a substrate for an inkjet printing head in an embodiment of the present invention.

FIG. 1 is a perspective view for explaining a configuration of a substrate for an inkjet printing head in an embodiment of the present invention. An ink supply port 120 is formed at the center of a silicon substrate 100, and a power wiring 134 for supplying power to individual heating resistor is formed at a position corresponding to an ink path for leading the ink to the individual heating resistor from the ink supply port 120.

Figure 2:
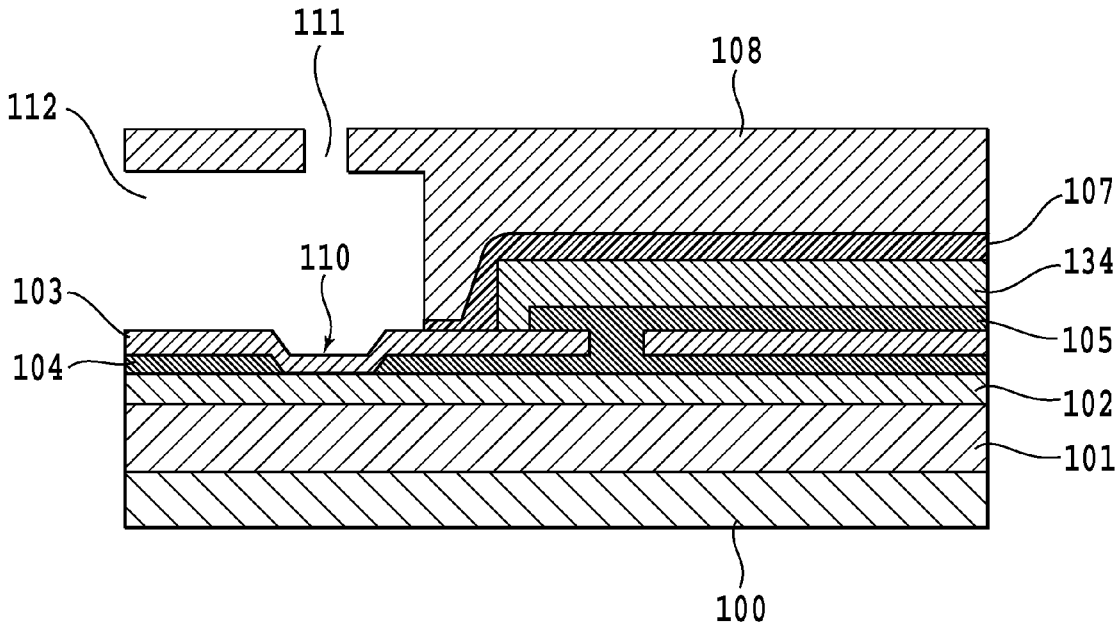
FIG. 2 is a structure cross sectional view in the vicinity of ink ejection opening, being II-II cross section of FIG. 1.
Figure 3A:
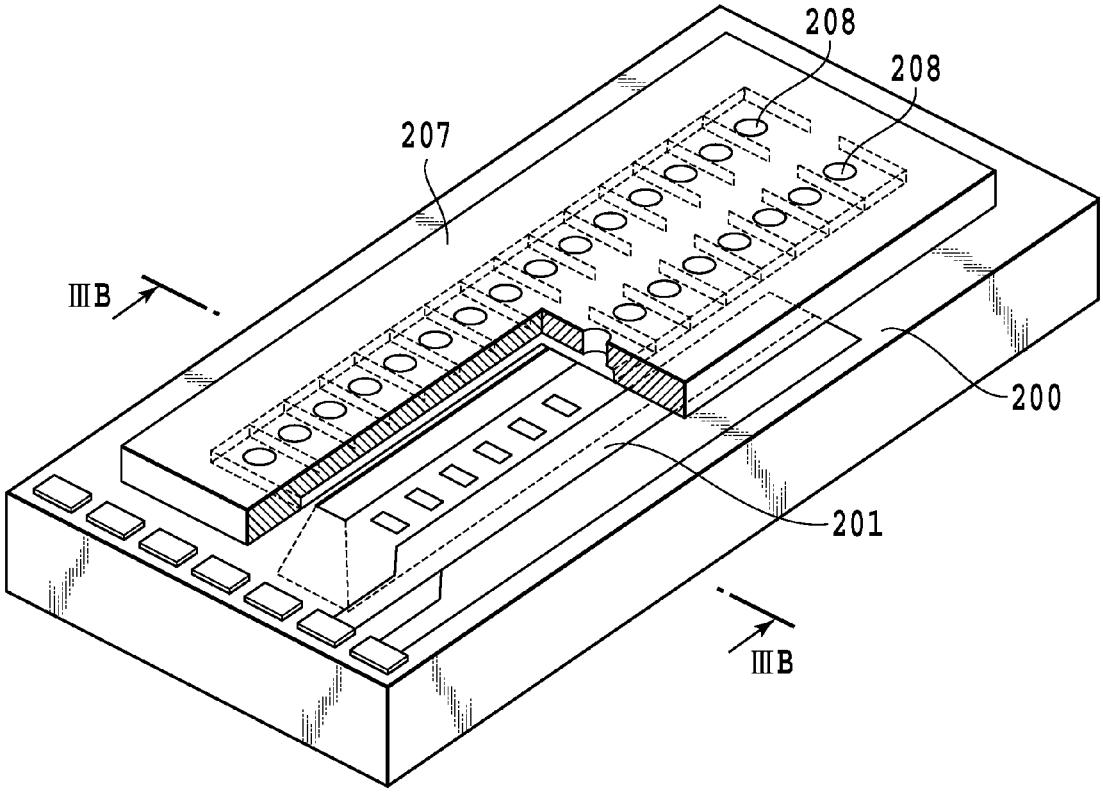
FIG.3A PRIOR ART
FIGS. 3A and 3B are a perspective view and a cross sectional view for explaining general configuration of a printing head adopting an inkjet printing system.
Figure 3B:
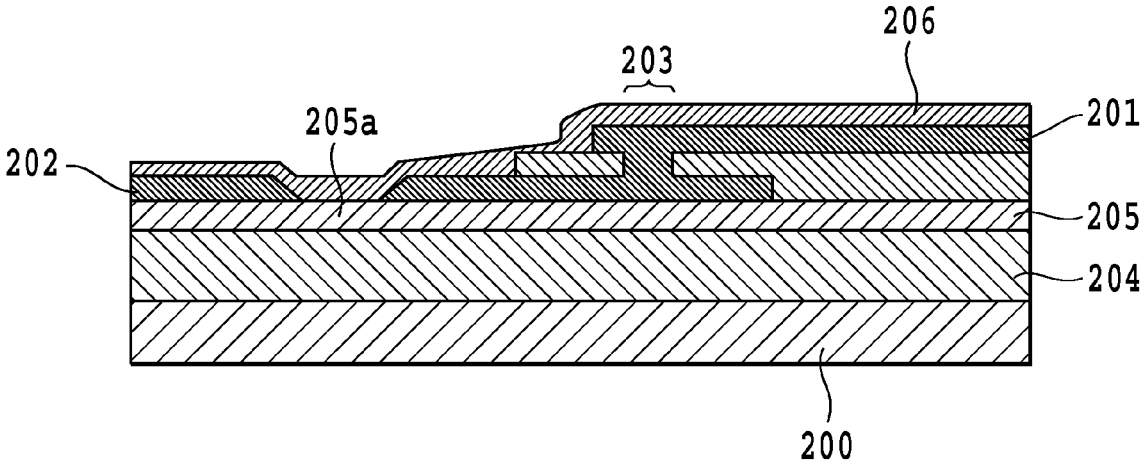
FIG.3B PRIOR ART

FIG. 2 is a structure cross sectional view in the vicinity of an ink ejection opening 111, being II-II cross section of FIG. 1. A reference number 101 denotes a heat storage layer composed of $SiO_2$ formed on a silicon substrate 100, reference number 102 denotes a heating resistor layer, reference number 104 denotes an individual aluminum wiring layer, and reference number 134 denotes a power wiring layer for supplying drive power to the individual aluminum wiring layer 104. A reference number 105 denotes a diffusion preventing layer for preventing diffusion of the power while mainly conducting foundation protection, which is also part of the power wiring layer 134. In addition, a reference number 103 denotes a protective layer in order that the individual aluminum wiring layer 104 does not come into directly contact with the ink. Further, reference number 108 denotes a flow path forming layer formed so that an ink path 112 and an ink ejection opening 111 are arranged at a position of an individual heating part 110, and the flow path forming layer 108 is adhered to the substrate on which above described respective layers are formed by a resin layer 107 also used for insulation of the power wiring.

A region not covered by the individual aluminum wiring layer 104 among the heating resistor layer 102 becomes the actual heating part 110. Then, the heating part 110 generates heat by the current supplied to the individual aluminum wiring 104 from the power wiring 134, bubbles are generated in the ink within the ink path 112, and the ink is ejected from the ink ejection opening 111 by a growing energy of the aforementioned bubbles.

In the present embodiment, there is provided a gold (Au) layer resulting in the first metal layer as the power wiring 134 for supplying the drive power to the individual aluminum wiring 104, and there is provided the diffusion preventing layer 105 resulting in the second metal layer at an adjacent position below the gold layer. Then, a structure is such that the diffusion preventing layer 105 being the second metal layer is wrapped up to not only an upper surface but also a side surface by the first metal layer. That is, a single metal (here the gold) appears on a surface of the power wiring 134 including up to its side surface of the present embodiment. Consequently, the battery reaction accompanied by the difference of the ionization tendency is not generated even when coming into contact with the ink or the moisture or the like.

FIGS. 4A to 4L are process charts for explaining the method for manufacturing the substrate for the printing head of the present embodiment having the structure described above.

Figure 4A:
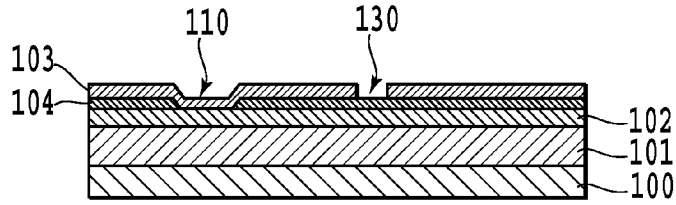
FIGS. 4A to 4L are process charts for explaining a method for manufacturing the substrate for the printing head in an embodiment of the present embodiment.

First, on the silicon substrate 100, the heat storage layer 101 composed of $SiO_2$, the heating resistor layer 102, the individual aluminum wiring 104, and the protective layer 103 are formed by a vacuum film forming method or the like. After that, a patterning is conducted by the photolithography technique, and a through hole 130 for obtaining electric conduction to the aluminum wiring 104 is formed (FIG. 4A).

Figure 4B:
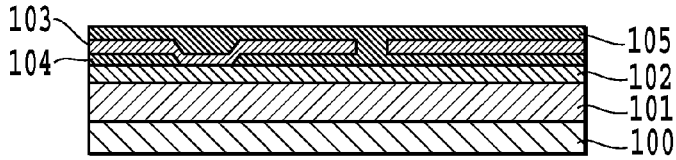

Continuously, by using a vacuum film formation apparatus or the like, the diffusion preventing layer 105 is formed by a forming film of entire surface with predetermined thickness using, for instance, titanium tungsten (TiW) of a high melting point metal material. Herewith, the through hole 130 is embedded with TiW, resulting in part of the diffusion preventing layer 105. (FIG. 4B)

Figure 4C:
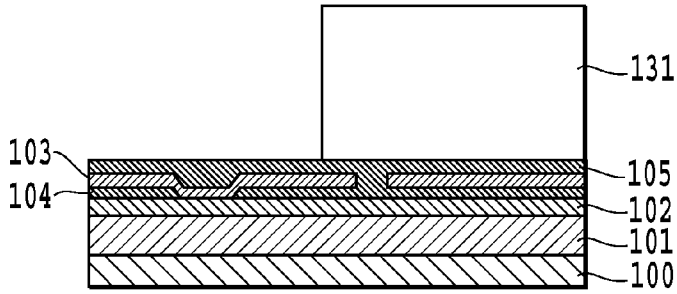

Next, by performing resist application, exposing and developing with the photolithography method, on a region where the diffusion preventing layer 105 is to be left, that is, on the through hole 130 and its near region, a photo resist 131 is formed. (FIG. 4C)

Figure 4D:
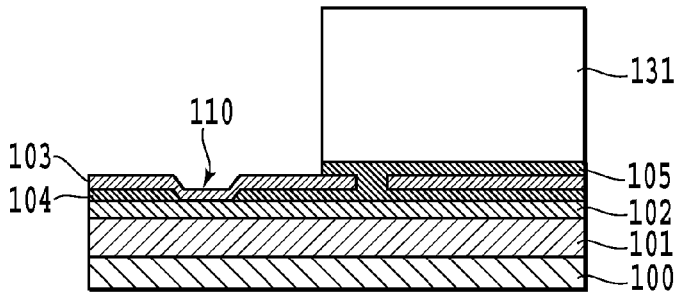

After that, the substrate is dipped into an etchant including $H_2O_2$ during predetermined time; the region not masked by the photo resist 131 of the diffusion preventing layer 105 is etched. (FIG. 4D)

Figure 4E:
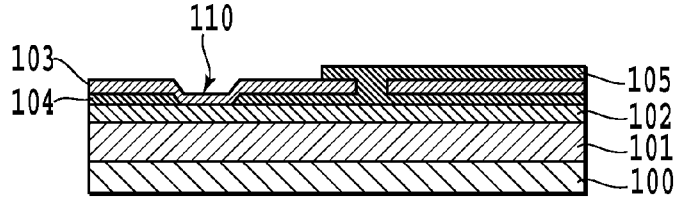

Further, the substrate is dipped into a stripping solution of the photo resist 131 during a predetermined time; the photo resist 131 is removed. As a result, the substrate having an upper stage surface and a lower stage surface is formed in which the diffusion preventing layer 105 remains only on the through hole 130 and its near region. (FIG. 4E)

Figure 4F:
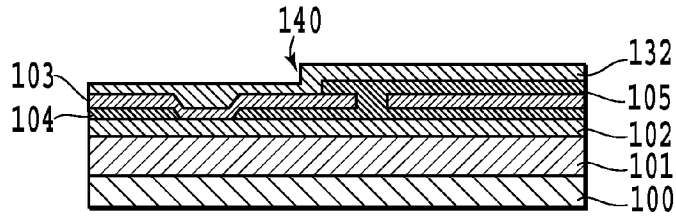

Next, by using a vacuum film formation apparatus or the like, the gold (Au) layer of the plating conductor is formed on entire surface with predetermined thickness. Herewith, the entire surface of the substrate is covered by a plating conductor gold layer 132 with a configuration having a step part 140. Meanwhile, in order to improve adhesiveness between the diffusion preventing layer 105 and the plating conductor gold (Au) layer 132, it is desirable to perform removal of an oxide film by using a reverse sputtering or the like. (FIG. 4F)

Figure 4G:
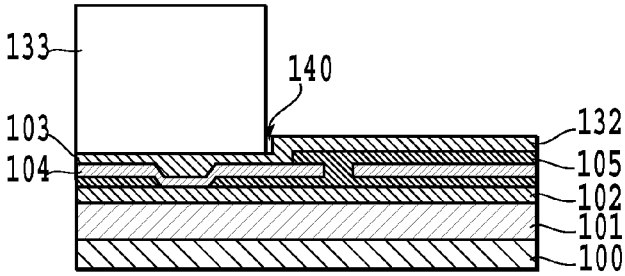

Next, by performing resist application, exposing and developing with the photolithography method, a photo resist 133 is formed. A forming position of the photo resist 133 is a position slightly away from the step 140 of the lower stage surface in the surface of the plating conductor gold (Au) layer 132. In addition, the photo resist 133 is made to be sufficiently higher than a surface of the power wiring 134 formed in the next process. (FIG. 4G)

Figure 4H:
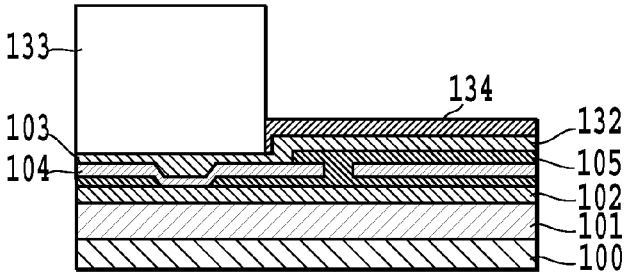

Subsequently, a predetermined current is caused to flow into the plating conductor gold 132 in the electrolytic solution including a gold sulfite. Herewith, new gold is deposited on a surface not masked by the photo resist 133 of the plating conductor gold (Au) layer 132, so that the power wiring layer 134 is formed. At this time, positions on which new gold is deposited among the surface of the plating conductor gold (Au) layer 132 are a surface of the upper stage surface, a side surface forming the step 140, and a surface to a position slightly away from the step 140 of the lower stage surface. (FIG. 4H)

Figure 4I:
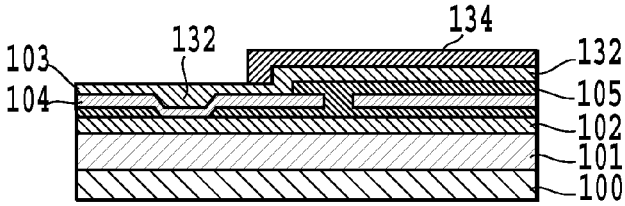

After that, the substrate is dipped into the stripping solution of the photo resist 133 during the predetermined time, and the photo resist 133 is removed. Herewith, the lower stage surface of the plating conductor gold layer 132 is exposed. (FIG. 4I)

Figure 4J:
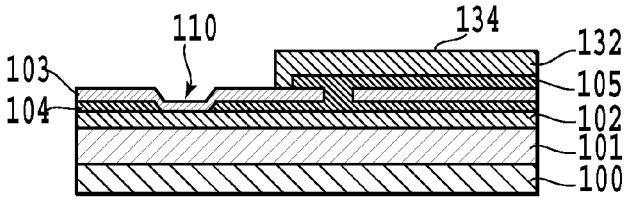

Next, the substrate is dipped into a water solution including a nitrogen-based organic compound, iodine, and potassium iodide during a predetermined time, and the unnecessary plating conductor gold layer 132 covering to the protective film 103 above the heating part is removed. In accordance with this, a characteristic structure of the present invention, that is, a structure of the power wiring 134 wrapping the diffusion preventing layer 105 is completed. (FIG. 4J)

Figure 4K:
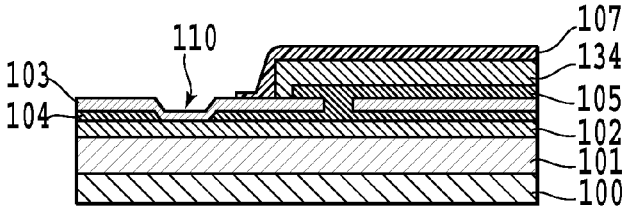

Further, as an insulating film, and as an adhesive layer between the power wiring 134 and the ink path forming layer 108, a resin layer 107 of, for instance, polyether amide resin is patterned using the photolithography method. (FIG. 4K)

Figure 4L:
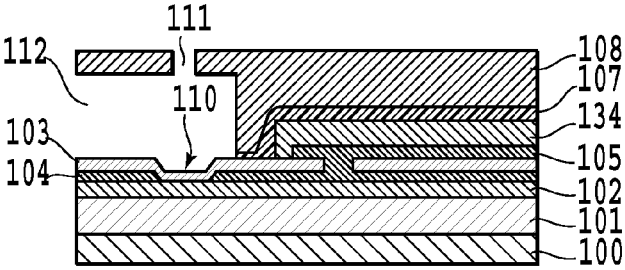

After that, further a shape material of post-punching corresponding to the ink path 112 is placed on the resin layer 107, the ink path forming layer 108 is applied by spin coat method with arbitrary thickness on the shape material, and the exposing and the developing are performed by the photolithography method. Then the substrate for inkjet printing as shown in FIG. 2 is obtained by removing the shape material, after forming a plurality of ink ejection openings 111. (FIG. 4L)

As explained above, according to the present invention, a structure is such that the whole surface of the diffusion preventing layer existing in a lower layer (internal layer) is covered by metal of the power wiring 134, and single metal appears on a surface of the power wiring 134 including its side surface. Consequently, even though circumstance where the power wiring comes into contact with the ink or the moisture or the like occurs, the battery reaction accompanied by difference of the ionization tendency is not generated, and the corrosion or short-circuit of the power wiring is suppressed. As a result, the problem of peeling-off of the ink path forming layer 108 caused by corrosion of the power wiring is improved, and thus, it is possible to achieve improvement of reliability of the printing head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-111992, filed Apr. 20, 2007, which is hereby incorporated by reference herein in its entirety.

What is claimed is:

1. A substrate for an inkjet printing head, comprising:

a heating resistor layer which generates heat by applying current;

a pair of electrodes set to contact with the heating resistor layer, wherein a region of the heating resistor layer positioned between the pair of electrodes set corresponds to an actual heating part;

a protect layer made of insulating material that is set to cover the pair of electrodes and a portion between the pair of electrodes of the heating resistor layer, the portion operating as a heating resistor element;

a first metal layer set on the protect layer; and a second metal layer made of a metal having higher ionization tendency than that of a metal of the first metal layer and provided between the first metal layer and the protective layer so as to be covered completely by the first metal layer, the second metal layer contacts one of the pair of electrodes through a through hole of the protect layer.

2. The substrate for the inkjet printing head according to claim 1, wherein the first metal layer is constituted by gold (Au).

3. The substrate for the inkjet printing head according to claim 1, wherein the second metal layer is constituted by titanium tungsten (TiW).

4. The substrate for the inkjet printing head according to claim 1, wherein at least part of the first metal layer contacts the second metal layer being deposited by a plating method.

5. The substrate for the inkjet printing head according to claim 1, further comprising:

an ink path forming layer having an ejection opening for ejecting ink and a wall of an ink path for leading ink to the ejection opening, the wall forming the ink path by being positioned to contact with the first metal layer.

6. The substrate for the inkjet printing head according to claim 1, wherein the second metal layer operates as a diffusion preventing layer.

* * * * *